US011033913B2

(12) United States Patent
Songbe et al.

(10) Patent No.: US 11,033,913 B2
(45) Date of Patent: Jun. 15, 2021

(54) DISPENSING HEAD WITH A STEPPED SWIRLING CHAMBER FOR A DISPENSING DEVICE

(71) Applicant: ALBEA SERVICES, Gennevilliers (FR)

(72) Inventors: Jean-Pierre Songbe, Le Mesnil-Réaume (FR); Thomas Nevens, Eu (FR)

(73) Assignee: ALBEA LE TREPORT, Le Treport (FR)

( * ) Notice: Subject to any disclaimer, the term of this patent is extended or adjusted under 35 U.S.C. 154(b) by 35 days.

(21) Appl. No.: 16/288,011

(22) Filed: Feb. 27, 2019

(65) Prior Publication Data

US 2019/0262847 A1 Aug. 29, 2019

(30) Foreign Application Priority Data

Feb. 27, 2018 (FR) ..... 1851712

(51) Int. Cl.
*B05B 1/34* (2006.01)
*B05B 11/00* (2006.01)

(52) U.S. Cl.
CPC ..... *B05B 1/3463* (2013.01); *B05B 1/3426* (2013.01); *B05B 1/3442* (2013.01); *B05B 1/3489* (2013.01); *B05B 11/3052* (2013.01)

(58) Field of Classification Search
CPC ..... B05B 1/34; B05B 1/3405; B05B 1/341; B05B 1/3421; B05B 1/3426; B05B 1/3436; B05B 1/3442; B05B 1/3463; B05B 1/3489; B05B 11/3052
See application file for complete search history.

(56) References Cited

U.S. PATENT DOCUMENTS 3,129,893 A * 4/1964 Green ..... B65D 83/44 239/490
3,881,658 A * 5/1975 Greenebaum, II .... B05B 1/3436 239/492
3,994,442 A * 11/1976 Hoening ..... B05B 1/3436 239/472
2008/0094936 A1 4/2008 Corti
2011/0057057 A1 3/2011 Songbe
2012/0141953 A1 6/2012 Mueller
2016/0236853 A1* 8/2016 Verville ..... B65D 83/205
2017/0297042 A1 10/2017 Songbe

* cited by examiner

*Primary Examiner* — Darren W Gorman
(74) *Attorney, Agent, or Firm* — Steven M. Greenberg, Esq.; Shutts & Bowen LLP

(57) ABSTRACT

A dispensing head with a staged swirling chamber for a dispensing system includes a spraying nozzle including a dispensing orifice and a swirling chamber opening into the dispensing orifice, the swirling chamber including a converging portion, and extending along an axis between an upstream end and a downstream end in the direction of displacement of the product, and an anvil including a core provided with a peripheral wall, that is housed inside the swirling chamber, and forming with the converging portion at least one fluidic path in which the product circulates, the converging portion including an inner wall of the nozzle, the inner wall and/or the peripheral wall of the core being provided with a plurality of steps, each step being defined by a transverse wall that extends in a plane secant to the axis and a longitudinal wall substantially parallel to the axis, the steps forming obstacles in the fluidic path.

12 Claims, 10 Drawing Sheets

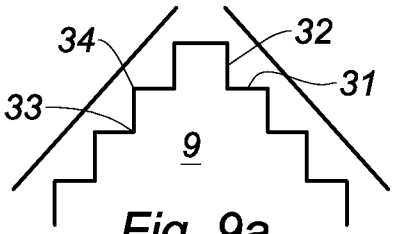
Fig. 9a
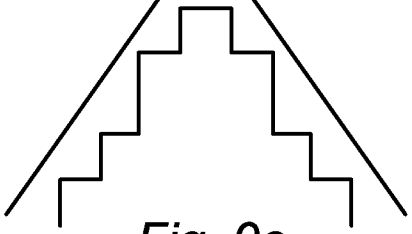
Fig. 9b
Fig. 9c
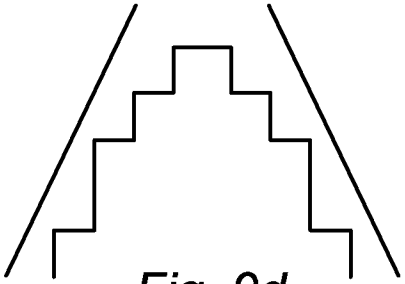
Fig. 9d
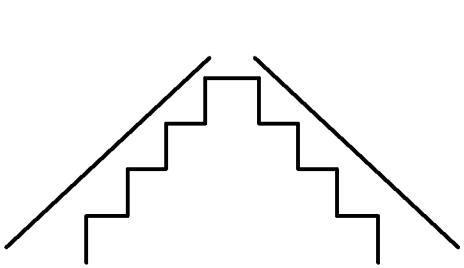
Fig. 9e
Fig. 9f
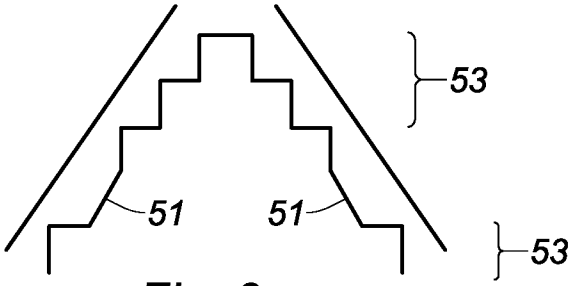
Fig. 9g

DISPENSING HEAD WITH A STEPPED SWIRLING CHAMBER FOR A DISPENSING DEVICE

CROSS REFERENCE TO RELATED APPLICATIONS

This application claims priority under 35 U.S.C. § 119(a) to French Patent Application Serial Number 1851712, filed Feb. 27, 2018, the entire teachings of which are incorporated herein by reference.

BACKGROUND OF THE INVENTION

Field of the Invention

The invention relates to a spraying device, in particular for a system for dispensing a product provided with a push-button.

Description of the Related Art

In a particular application, the dispensing system is intended to be provided on bottles used in perfumery, cosmetics or for pharmaceutical treatments. Indeed, this type of bottle contains a product which is supplied by the dispensing system including a device for collecting the product, the system being actuated for example by a push-button in order to allow for the spraying of the product. In general, the device for collecting includes a pump or a valve with manual actuation, for example by means of the push-button.

Such push-buttons are conventionally made of two portions, of which one is an actuating body and one a spraying nozzle, both being assembled one to the other. The nozzle generally includes a swirling chamber provided with a dispensing orifice, as well as at least one supply channel of the chamber.

The device for collecting samples the product from the bottle via a dip tube, and pushes it inside the duct arranged in the plunger, which is the actuating element of the collecting device. This duct opens into a so-called swirling chamber intended to rotate the liquid very quickly and therefore to give it the speed and the effects of centrifugal force. This swirling chamber is extended at its center by an outlet orifice through which the product escapes outside at a high speed. Moved by this speed, and subjected to the centrifugal forces, the liquid breaks up into droplets and forms an aerosol. The size of the droplets coming from the swirling chamber partially depends on the force and on the speed with which the user actuates the pump by pressing on the push-button with their finger, as the induced pressure depends on this.

In order to ensure good uniformity of the size of the droplets, one technology consists in using a revolution swirling chamber. Thus, the flow rotates in the chamber in the form of a sheet that is impacted on itself after the exiting therefrom through the dispensing orifice.

This technology is used for products that are not viscous or hardly viscous.

When the product is viscous, typically with about 50 or 100 times the viscosity of water, the impaction of the sheets does not occur correctly, for example when the viscosity is greater than 150 mPa·s. This results in an excessively large size of the droplets and the cone of sprayed product is then of poor quality.

In order to improve the cone of the sprayed product, when the product is viscous, one technology consists in adding steps in the swirling chamber.

The steps make it possible to improve the impaction of the sheets of product and to obtain droplets of small dimensions with a viscous product.

Although this technology improves the sprayed cone, a disadvantage remains. Indeed, the dimensions of the droplets are suitable in most of the sprayed cone which makes it possible to obtain a cone of fine droplets of product. However, a central zone of the cone does not have the needed requirements. This central zone is located immediately downstream from the dispensing orifice in the direction of displacement of the product, and extends substantially in a straight line. In this central zone, the droplets have dimensions that are much greater than in the rest of the cone. Frequently, a continuous stream in a central zone coexists with the peripheral droplets. In other words, the dimensions of the droplets are not uniform in the cone.

A user then receives, on their hands or another part of their body, product in the form of a continuous stream in the central zone, amongst a cone of fine droplets. The experience of the product is consequently altered. This is all the truer with customers whose expectations are often high. In addition to the unpleasant sensation that the continuous stream produces, the latter reflects a poor image of the product and of its manufacturer, despite the cosmetic qualities that it contains.

BRIEF SUMMARY OF THE INVENTION

The present invention relates to a dispensing head, in particular for a system for dispensing a product. The head includes a spraying nozzle including a dispensing orifice and a swirling chamber opening into the dispensing orifice, the swirling chamber including a converging portion, the swirling chamber extending along an axis, between an upstream end and a downstream end in the direction of displacement of the product, an anvil including a core provided with a peripheral wall, the core being housed inside the swirling chamber, the peripheral wall and the converging portion forming at least one fluidic path in which the product circulates. The converging portion includes an inner wall of the nozzle, the inner wall and/or the peripheral wall of the core is provided with a plurality of steps, each step being defined by a transverse wall that extends in a plane secant to the axis and a longitudinal wall substantially parallel to the axis, the steps forming obstacles in the fluidic path.

This dispensing head has the advantage of eliminating the continuous stream that appears in the central zone. This is made possible by the combined action of the converging portion provided with steps and of a core forming at least one fluidic path wherein the product encounters obstacles. This is also made possible by the combined action of the converging portion and of a core provided with steps as well as a converging portion and a core, both provided with steps. The dispensing head is particularly advantageous when the product has a non-Newtonian rheological behaviour. This type of fluid is fluidified as the rate of shearing increases. This type of product is widely used in the cosmetics industry. The central zone then includes droplets of which the dimensions are substantially identical in the entire cone.

According to various embodiments of the invention, that can be taken together or separately:

- the converging portion includes at least one step nosing located at the junction between a transverse wall and a longitudinal wall, the step nosing being located at a proximal distance of between 70 and 250 micrometres from the peripheral wall of the core measured along an imaginary straight line traced from the step nosing to the peripheral wall following the shortest route;

a length of the longitudinal wall is between 30 and 250 micrometres measured along the axis;

a length of the transverse wall is between 30 and 350 micrometres measured along an axis orthogonal to the axis;

the steps extend from the upstream end to the downstream end;

the converging portion includes between three and fifteen steps, preferably four steps;

the swirling chamber includes a pre-chamber upstream from the converging portion;

the nozzle includes at least one supply channel of the swirling chamber;

the channel or channels open into the pre-chamber;

the pre-chamber is annular;

the height of the channel or channels corresponds to the height of the pre-chamber;

the channel or channels open tangentially into the swirling chamber;

the core includes a cone-shaped portion revolving about the axis and defines a top located opposite the dispensing orifice;

the top is flat and includes a planar wall substantially perpendicular to the axis;

the core is solid;

the dispensing orifice is only connected fluidically to the converging portion of the nozzle.

The invention also relates to a system for dispensing a product including a dispensing head such as described hereinabove.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIGS. 9*a*, 9*b*, 9*c*, 9*d*, 9*e*, 9*f*, 9*g* diagrammatically show alternative embodiments wherein a core includes steps;

DETAILED DESCRIPTION OF THE INVENTION

Figure 1:
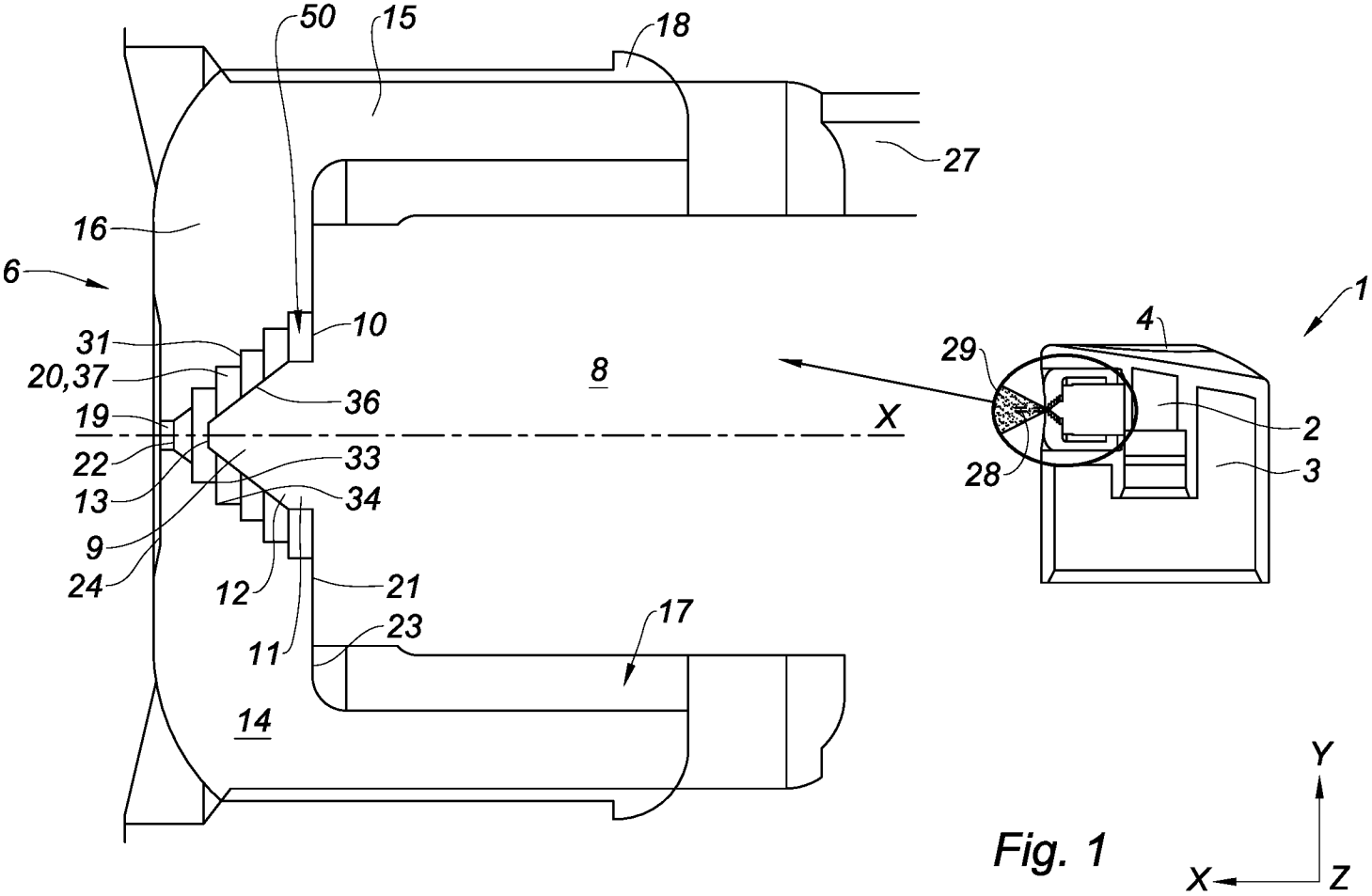
FIG. 1 is a two-dimensional cross-section view of a dispensing head according to the invention.

FIG. 1 shows a dispensing head 1, in particular for a system for dispensing (not shown) a fluid product.

The dispensing system includes the dispensing head 1 and a device for collecting (not shown) provided with a feed tube inserted into a well 2 located in the dispensing head 1.

In the rest of the description, by convention the direct orthogonal coordinate system defined as follows is used:

an axis X defining a first direction, which corresponds to the axis of a swirling chamber of the dispensing head 1, an axis Y orthogonal to the X axis and defining a second direction as well as a plane XY, an axis Z orthogonal to both the Y axis and to the X axis and defining a third direction as well as planes ZY and ZX.

The dispensing head 1 includes a body 3. The body 3 defines a support wall 4 located on an upper portion of the latter. The support wall 4 allows the user to press the dispensing head 1 in order to spray the product.

Figure 3:
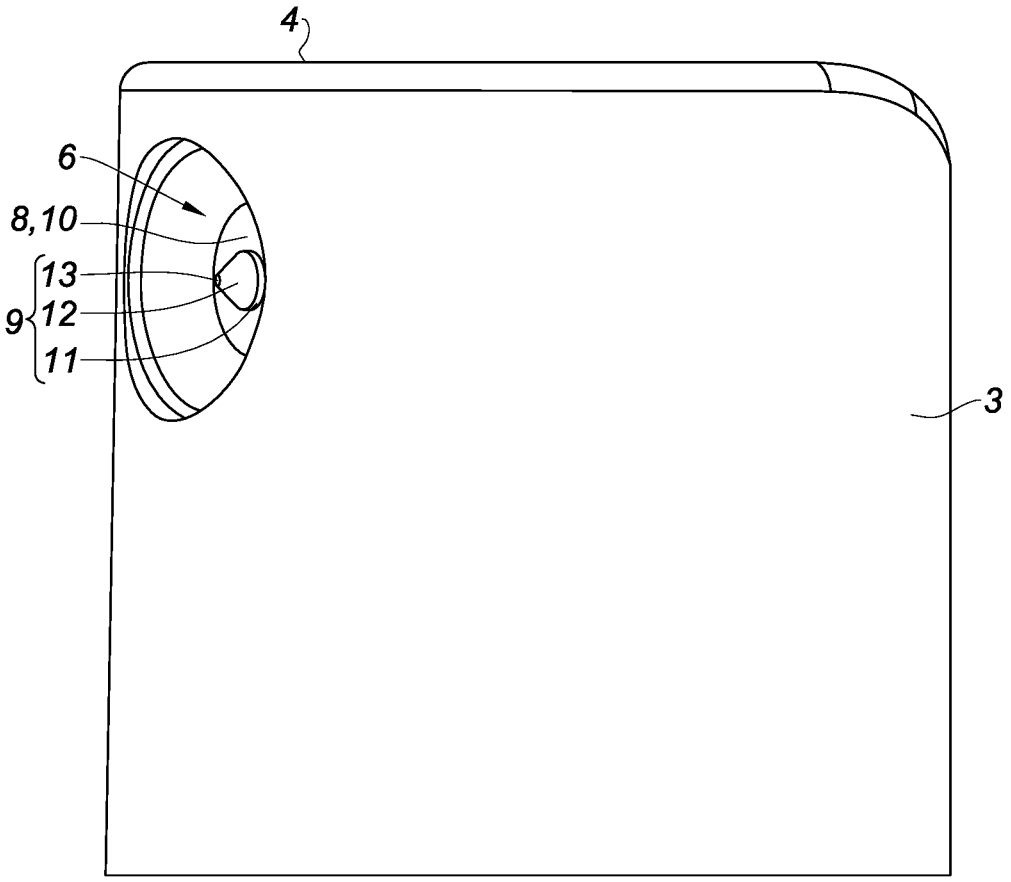
FIG. 3 is a perspective view of the dispensing head of FIG. 1 without the dispensing nozzle.
Figure 4:
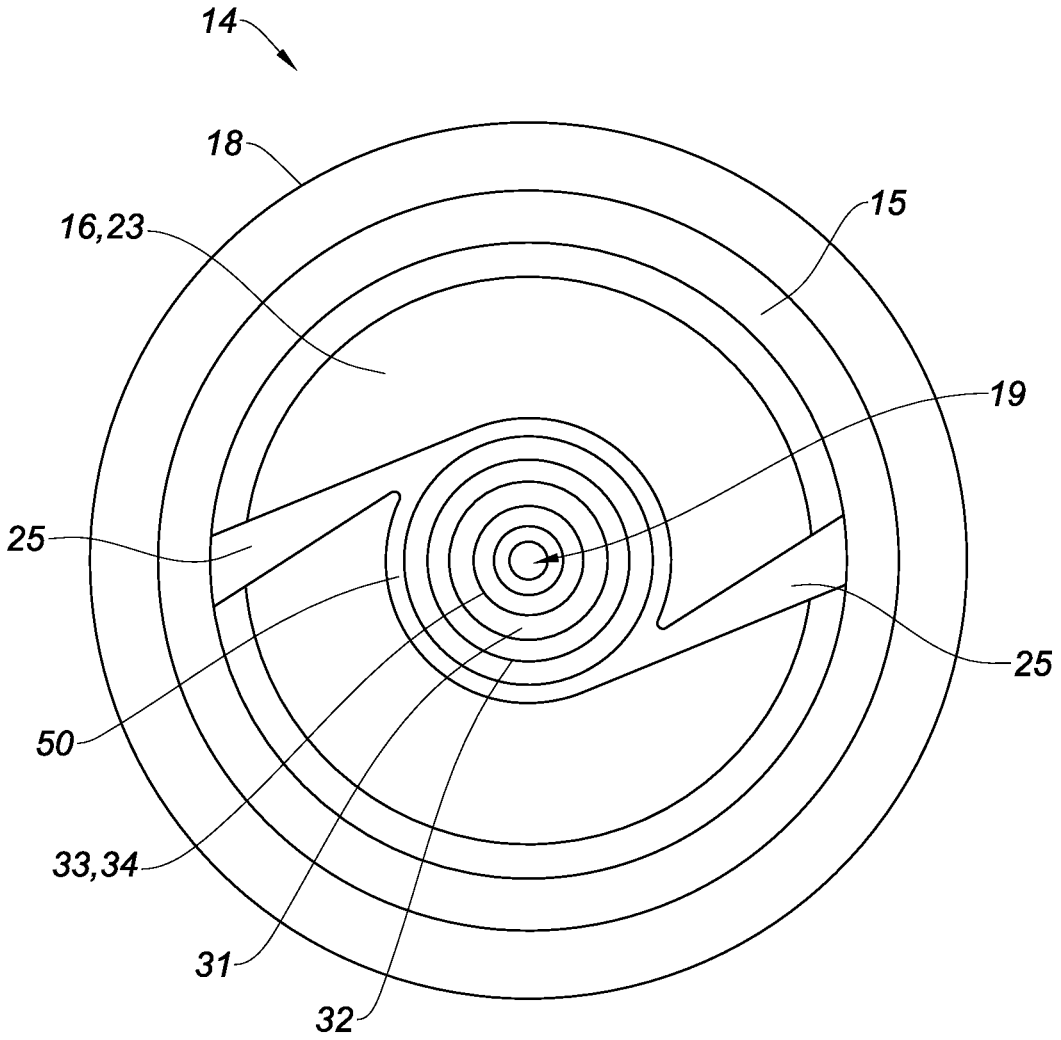
FIG. 4 is a two-dimensional view of the dispensing nozzle of FIGS. 1 and 2.

As shown in FIG. 3, the body 3 defines a housing 6. The housing 6 is in fluidic communication with the well 2. This fluidic communication is achieved through an inner channel 27 made in the body 3.

The body 3 includes an anvil 8. More preferably, the anvil 8 is made from a single piece with the dispensing head 1. The anvil 8 extends longitudinally according to the X axis into the housing. The anvil 8 has a circular section in the plane ZY.

The anvil 8 includes a core 9 visible in FIGS. 1 and 3. The core 9 has the form of an element protruding according to the X axis from a distal surface 10 of the anvil 8.

The core 9 includes a cylindrical portion 11. The cylindrical portion 11 is located at the base of the core and is adjacent to the distal surface 10 of the anvil 8. The core 9 includes a cone-shaped portion 12 revolving about the axis X. The conical portion 12 extends from the cylindrical portion 11 and finishes with a top 13. The top 13 is flat. The top 13 has the form of a planar wall substantially perpendicular to the axis X.

The cylindrical portion 11 and the conical portion 12 together form a peripheral wall 36 of the core 9.

The dispensing head 1 includes a spraying nozzle 14. The spraying nozzle 14 is an element added on the dispensing head 1. The spraying nozzle 14 includes an annular wall 15 forming a volume open on one side and closed on the other by a distal wall 16. The spraying nozzle 14 defines a central opening 17 laterally bordered according to the axes Y and Z by the annular wall 15 and longitudinally according to the X axis by the distal wall 16. The annular wall 15 includes a locking tab 18. The locking tab 18 has the form of a protruding annular edge, which extends along the perimeter of the annular wall 15.

The distal wall 16 includes a dispensing orifice 19 and a swirling chamber 20. The swirling chamber 20 opens into the dispensing orifice 19. The swirling chamber 20 revolves about the axis X. More precisely, the swirling chamber 20 includes a converging portion 37. The swirling chamber 20 includes an inner wall 35 and extends from an upstream end 21 coinciding with an inner surface 23 of the distal wall 16 to a downstream end 22. The downstream end 22 can easily be located by being positioned in the dispensing orifice 19 and then by being displaced according to the X axis from an outer surface 24 of the distal wall 16. The dispensing orifice 19 is a revolving cylinder, thus the section of the latter is substantially constant. The location where the section begins to vary is the border between the dispensing orifice 19 and the swirling chamber 20, namely the downstream end 22.

In an alternative embodiment not shown, the downstream end 22 of the swirling chamber 20 is the dispensing orifice 19. In other terms, the dispensing orifice 19 coincides with the downstream end 22.

In an alternative embodiment not shown in the figures, only a portion of the swirling chamber 20 revolves.

In the shown embodiment, the swirling chamber 20 further includes a pre-chamber 50, located upstream from the converging portion 37 of the swirling chamber. The pre-chamber 50 is here annular. It is delimited by the cylindrical portion 11 of the core 9, the portion opposite the distal wall 16 of the nozzle, the distal surface 10 of the anvil and the converging portion 37 of the swirling chamber. Thus, the upstream end of the chamber 20 corresponds to the upstream end of the pre-chamber 50.

The dispensing nozzle 14 includes at least one supply channel 25 of the swirling chamber 20. In the preferred embodiment shown in the figures, the dispensing nozzle 14 includes two supply channels 25. The supply channels 25 are made in the distal wall 16.

The supply channels 25 open tangentially into the annular pre-chamber 50 belonging to the swirling chamber 20. They could open along any other orientation. In particular, the channels 25 could open according to a direction tangential to the first step 30, immediately downstream from the pre-chamber 50. The pre-chamber 50 allows for the rotation of the product around the cylindrical portion 11 of the core 9. The annular pre-chamber 50 has a length measured along the axis X equal to a depth of the supply channels 25 measured along the axis X. The annular pre-chamber 50 is not a step in the sense of the invention.

As mentioned hereinabove, the spraying nozzle 14 is a separate element added on the dispensing head 1. More precisely, the spraying nozzle 14 is inserted into the housing 6 and fixed to the body 3 thanks to the locking tab 18 embedded into the body 3.

As shown in FIG. 1, the anvil 8 is partially arranged in the central opening 17 of the nozzle in such a way that the distal surface 10 is in abutment on the inner surface 23. The core 9 is thus housed inside the swirling chamber 20. The peripheral wall 36 of the core 9 and the converging portion 37 of the swirling chamber 20 form a fluidic path in which the product coming from the supply channel 25 circulates.

Figure 2:
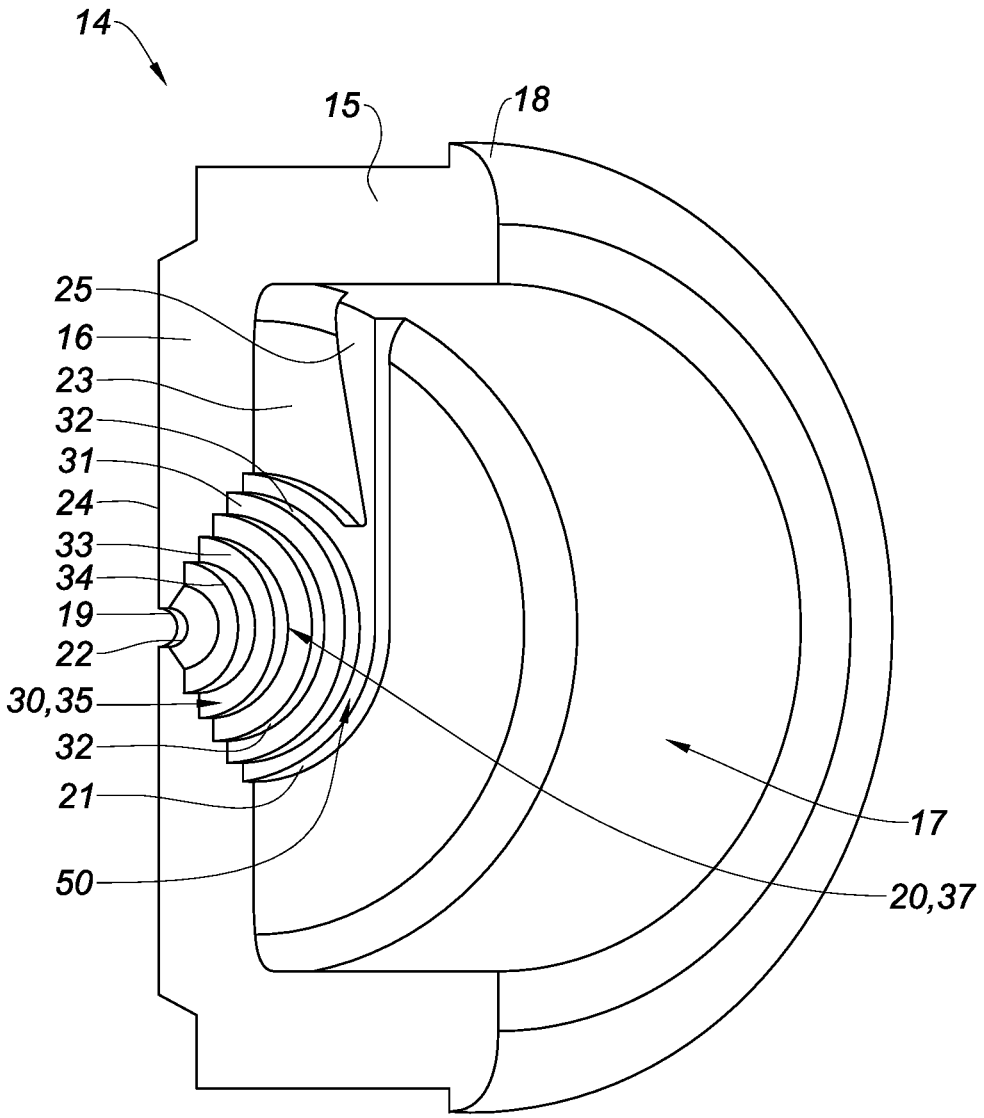
FIG. 2 is a perspective and cross-section view of a dispensing nozzle of the dispensing head of FIG. 1.

As can be seen in FIGS. 1 and 2, the converging portion 37 of the swirling chamber 20 includes a plurality of steps 30. A step 30 is defined by a transverse wall 31 and a longitudinal wall 32.

The transverse wall 31 extends in a plane secant to the X axis. Indeed, by extending the transverse wall 31 in the direction of the X axis using an imaginary straight line in FIG. 1, the latter cuts the X axis. The longitudinal wall 32 is substantially parallel to the axis X. By extending the longitudinal wall 32 on either side to infinity with an imaginary straight line, the latter is substantially parallel to the axis X.

In this configuration, the steps 30 form obstacles in the fluidic path. More precisely, the transverse walls 31 of the steps 30 form obstacles in the fluidic path.

The combination of the steps 30 and of a core 9 that extends in the swirling chamber 20 makes it possible to eliminate the continuous stream that appears in a central zone 28 of a cone 29 of droplets sprayed at the output of the dispensing orifice 19. In other words, the combination of the core 9 and the steps 30 forming obstacles in the fluidic path advantageously makes it possible to obtain in the central zone 28 droplets that have dimensions that are identical or otherwise similar to the droplets present in the rest of the sprayed cone 29. Thus the dimensions of the droplets in the cone 29 are substantially uniform.

In a preferred embodiment of the invention, the transverse walls 31 are substantially orthogonal to the X axis. The impact with the product in the fluidic path is then sudden, which results in a better impaction of the product on the steps 30.

In an alternative embodiment not shown, the transverse walls 31 are not orthogonal. In this latter case the energy of the impact between the product and the transverse walls 31 is not as high. The energy of the impact of the product against the steps 30 can be adjusted by modifying the angle that the transverse walls 31 form with the X axis.

Each transverse wall 31 crosses at each one of its ends a longitudinal wall 32. In what follows, these intersections are referred to as step nosing 33 and step hollows 34 according to their separation in the plane ZY of the peripheral wall 36 of the core 9.

In a preferred embodiment, the step nosing 33 is located at a proximal distance of between 70 and 250 micrometres from the peripheral wall 36 of the core 9. In FIG. 1, this proximal distance is measured along an imaginary straight line traced from the step nosing 33 to the peripheral wall 36 following the shortest route. More preferably the proximal distance is of about 160 micrometres.

The proximal distance providing the interval mentioned hereinabove and more particularly the specific values indicated, allow for shearing of the product that is sufficient in the vicinity of the step nosing 33 against the peripheral wall 36 of the core 9. This results in a localised increase in the rate of shearing induced by the peripheral wall 36 in the vicinity of the step nosing 33 that makes it possible to reduce the viscosity of the product. In other terms, this makes it possible to fluidify the product.

It has been determined that a length of between 30 and 350 micrometres for the transverse wall 31 measured along the axis Y in FIG. 1 and in the plane ZY in perspective, is particularly effective. It has also been determined that a length of between 30 and 250 micrometres for the longitudinal wall 32 according to the X axis in FIG. 1 and in the plane ZX in perspective is particularly effective.

In a preferred embodiment shown in the figures, the converging portion 37 of the swirling chamber 20 includes between three and fifteen steps 30 and preferably four steps 30. Thus, the converging portion 37 includes more preferably four transverse walls 31 and four longitudinal walls 32. This makes it possible to obtain significant results with a total elimination that is otherwise quasi-total of a continuous stream in the central zone 28.

Advantageously, the core 9 is arranged inside the swirling chamber 20 in such a way that any point of the planar wall is located at a predetermined distance from the downstream end of between 100 and 300 micrometres, and more preferably of about 200 micrometres. This distance is particularly advantageous as it allows for an optimum evacuation of the product in that the product is both correctly fluidified on the one hand and it limits the load loss when circulating in the fluidic path.

The core 9 and more precisely the planar wall is arranged next to the dispensing orifice 19 in such a way that the core defines an obstacle to any intrusion from the external environment by the dispensing orifice 19 in such a way as to not obstruct the ducts.

Advantageously the core 9 of the anvil 8 is solid. In other terms, the core 9 does not include any orifice whatsoever that opens for example onto the external environment on the one hand and onto the swirling chamber 20 on the other hand or onto any portion whatsoever of the housing 6.

Advantageously the dispensing orifice 19 is only connected fluidically to the converging portion 37. In other terms, the dispensing nozzle 14 does not include any channel or output that connects the swirling chamber 20 or the housing 6 to the external environment, for example when it is mounted on the body 3.

This advantageously makes it possible to maintain the favourable pressure conditions in the swirling chamber 20 and more globally in the housing 6 on the one hand and to prevent any bacterial contamination with the external environment on the other hand.

Figure 5:
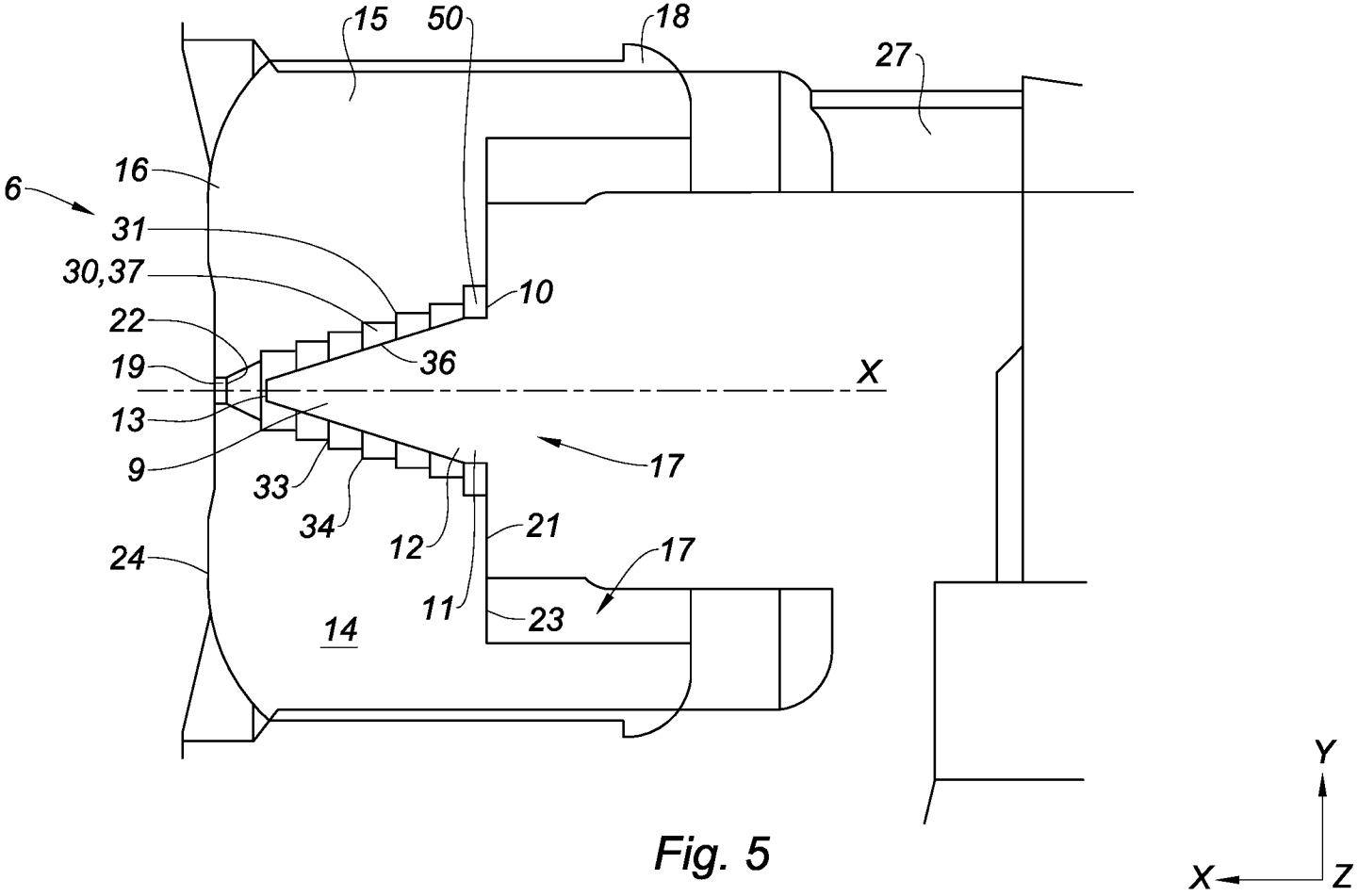
FIG. 5 is a view similar to FIG. 1 of a second embodiment.
Figure 6:
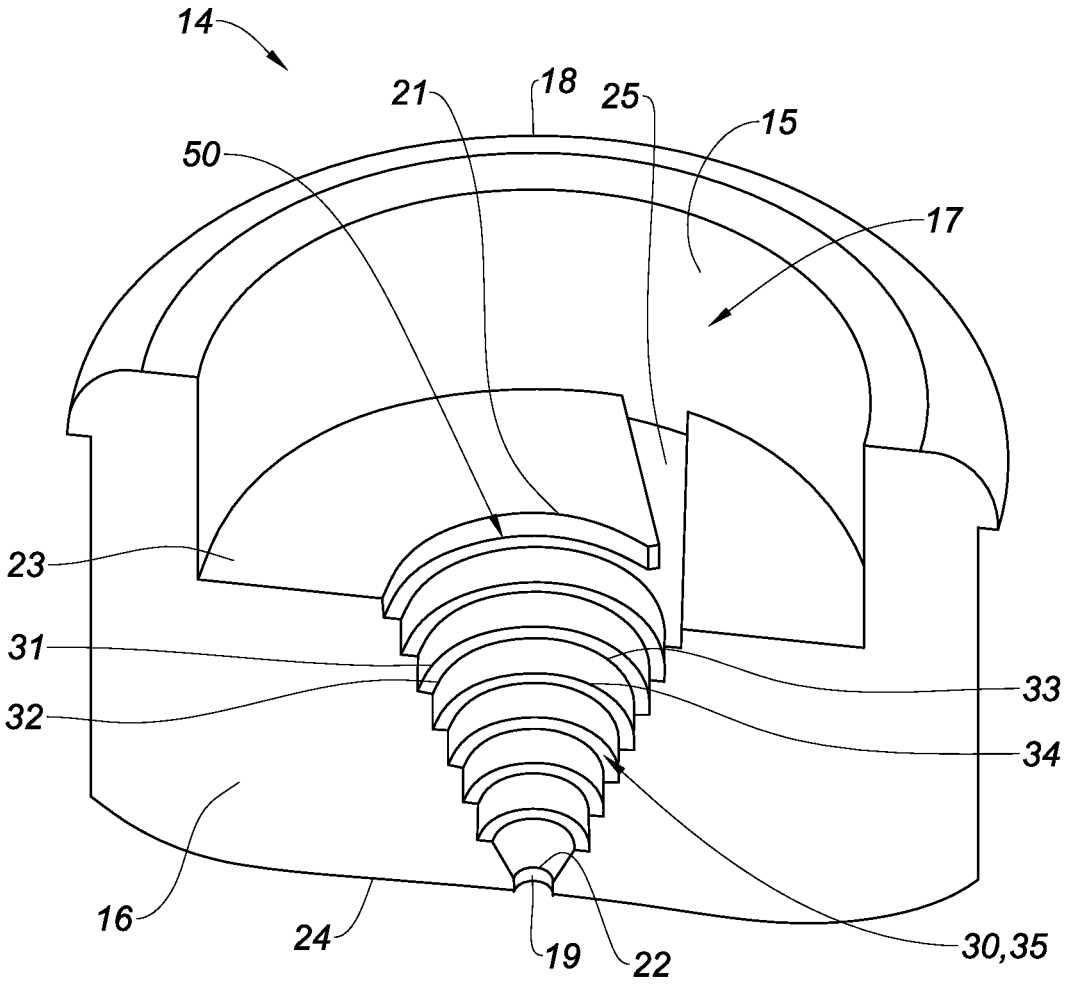
FIG. 6 is a view similar to FIG. 2 of the second embodiment of FIG. 5.
Figure 7:
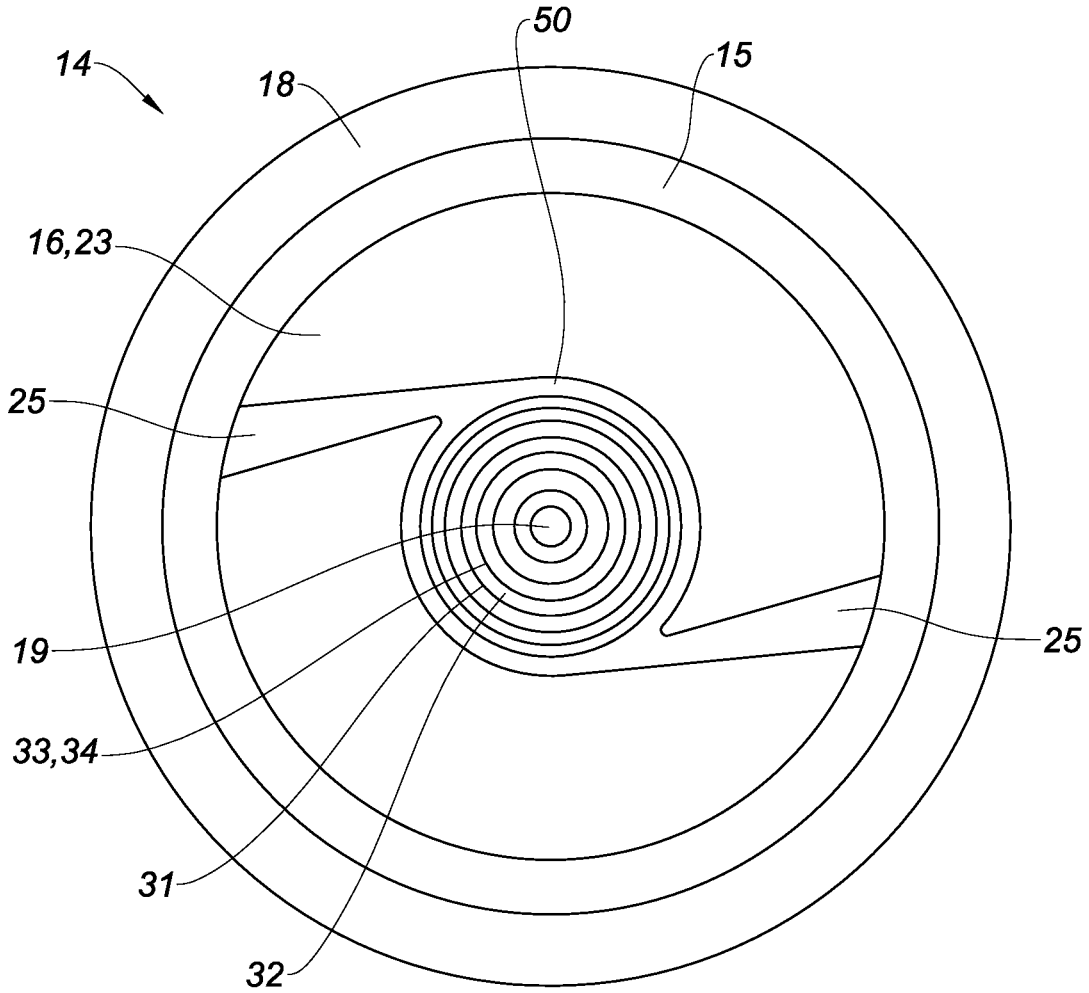
FIG. 7 is a view similar to FIG. 3 of the second embodiment.

In an alternative embodiment shown in FIGS. 5 to 7, the swirling chamber 20 is longer along the X axis than that of the embodiment shown in FIGS. 1 to 4.

FIGS. 8*a* to 8*g* show embodiments wherein the steps are arranged on the nozzle.

FIGS. 9*a* to 9*g* show embodiments wherein the steps are arranged on the core.

FIGS. 10*a* to 10*g* show embodiments wherein the steps are arranged on the nozzle and on the core.

Figure 8A:
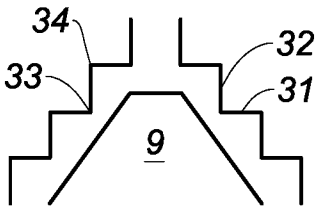
FIGS. 8*a*, 8*b*, 8*c*, 8*d*, 8*e*, 8*f*, 8*g* diagrammatically show alternative embodiments wherein the nozzle includes steps.
Figure 10A:
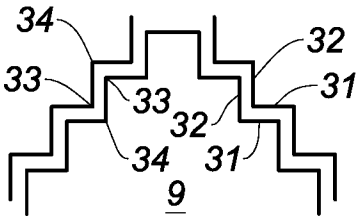
FIGS. 10A, 10B, 10B, 10C, 10D, 10E, 10F, 10G diagrammatically show alternative embodiments wherein the nozzle and the core include steps.

FIGS. 8*a*, 9*a* and 10*a* show alternatives wherein longitudinal and transverse walls are approximately the same dimension.

Figure 8B:
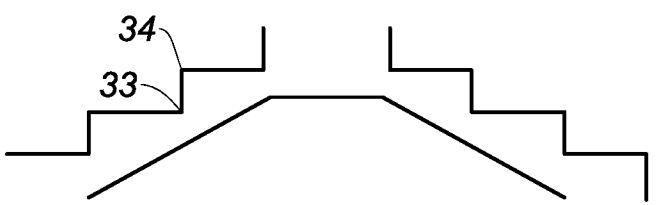
Figure 10C:
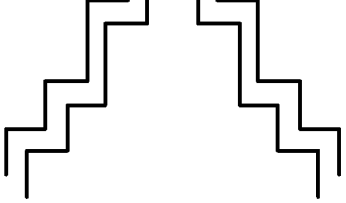
Figure 10D:
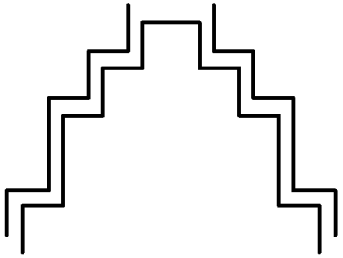
Figure 10B:
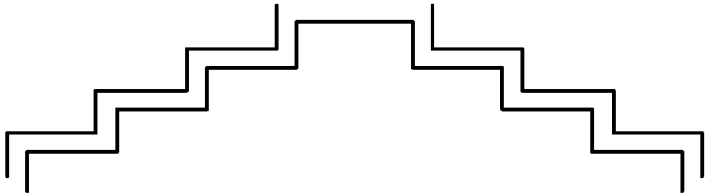

FIGS. 8*b*, 9*b* and 10*b* show alternatives wherein longitudinal and transverse walls are of different dimensions.

Figure 8C:
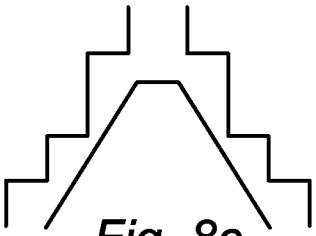

FIGS. 8*c*, 9*c* and 10*c* show alternatives wherein the longitudinal wall located most downstream according to the displacement of the fluid is longer than the other longitudinal walls located further upstream.

Figure 8D:
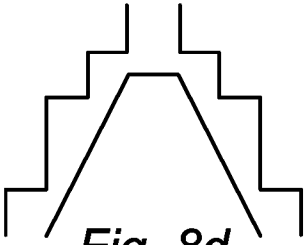

FIGS. 8*d*, 9*d* and 10*d* show alternatives wherein any longitudinal wall is longer than the other longitudinal walls.

Figure 8E:
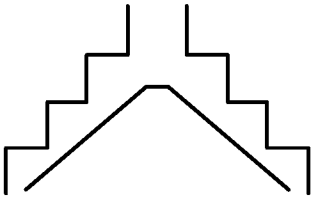
Figure 10F:
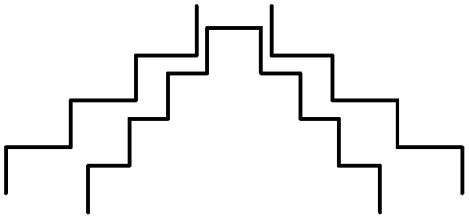
Figure 10G:
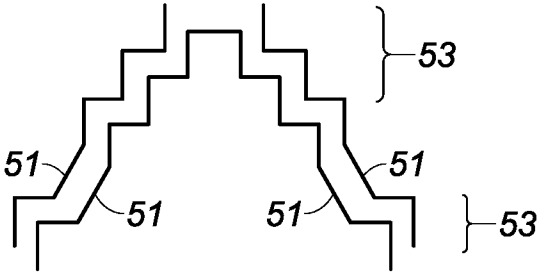
Figure 10E:
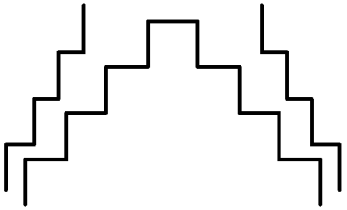

FIGS. 8*e*, 9*e* and 10*e* show alternatives wherein the fluidic path is divergent.

Figure 8F:
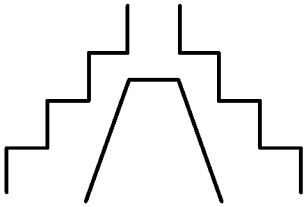

FIGS. 8*f*, 9*f* and 10*f* show alternatives wherein the fluidic path is convergent. This alternative is particularly interesting as it allows for an increasing rate of shearing in the upstream to downstream direction according to the displacement of the product.

Figure 8G:
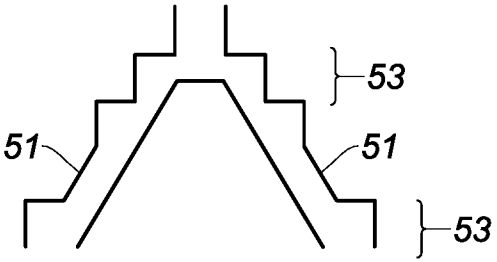

FIGS. 8*g*, 9*g* and 10*g* show alternatives wherein a planar intermediate section 51 separates two groups of steps 53.

In an alternative embodiment not shown in the figures, the steps can be arranged by angular sector. In other terms, the steps extend uninterruptedly around the perimeter of the converging portion 37 of the swirling chamber 20 and/or of the peripheral wall 36 of the core 9. In this alternative, the core 9 and/or the swirling chamber 20 include at least two groups of steps separated by smooth walls.

The invention also relates to a system for spraying a product including a dispensing head 1 such as described hereinabove.

Having thus described the invention of the present application in detail and by reference to embodiments thereof, it will be apparent that modifications and variations are possible without departing from the scope of the invention defined in the appended claims as follows:

We claim:

1. A dispensing head for dispensing a product comprising:

a spraying nozzle comprising a dispensing orifice and a swirling chamber opening into the dispensing orifice, the swirling chamber comprising a converging portion, said swirling chamber extending along an axis between an upstream end and a downstream end in the direction of displacement of the product, and an anvil comprising a core provided with a peripheral wall, the core being housed inside the swirling chamber, the peripheral wall and the converging portion forming at least one fluidic path in which the product circulates, the converging portion comprising an inner wall of the nozzle, at least one of the inner wall and the peripheral wall of the core being provided with a plurality of steps, each step being defined by a transverse wall that extends in a plane secant to the axis and a longitudinal wall substantially parallel to the axis, the steps forming obstacles in the fluidic path, the nozzle comprising at least one supply channel of the swirling chamber opening tangentially into the swirling chamber, wherein the swirling chamber comprises a pre-chamber upstream from said converging portion, with the channel or channels opening into the pre-chamber;

wherein the core comprises a cone-shaped portion revolving about the axis and defining a top located next to the dispensing orifice.

2. The dispensing head according to claim 1, wherein the converging portion comprises at least one step nosing located at the junction between a transverse wall and a longitudinal wall, the step nosing being located at a proximal distance of between 70 and 250 micrometres from the peripheral wall of the core measured along an imaginary straight line traced from the step nosing to the peripheral wall along the shortest route.

3. The dispensing head according to claim 2, wherein a length of the longitudinal wall is of between 30 and 250 micrometres measured along the axis.

4. The dispensing head according to claim 2, wherein a length of the transverse wall is of between 30 and 350 micrometres measured along an axis orthogonal to the axis.

5. The dispensing head according to claim 1, wherein the steps extend from the upstream end to the downstream end.

6. The dispensing head according to claim 1, wherein the converging portion comprises four steps.

7. The dispensing head according to claim 1, wherein the pre-chamber is annular.

8. The dispensing head according to claim 1, wherein the height of the channel or channels corresponds to the height of the pre-chamber.

9. The dispensing head according to claim 1, wherein the top is flat and comprises a planar wall substantially perpendicular to the axis.

10. The dispensing head according to claim 1, wherein the core is solid.

11. The dispensing head according to claim 1, wherein the dispensing orifice is only connected fluidically to the converging portion of the nozzle.

12. A system for dispensing a product comprising:

a dispensing head comprising:

a spraying nozzle comprising a dispensing orifice and a swirling chamber opening into the dispensing orifice, the swirling chamber comprising a converging portion, said swirling chamber extending along an axis between an upstream end and a downstream end in the direction of displacement of the product, and an anvil comprising a core provided with a peripheral wall, the core being housed inside the swirling chamber, the peripheral wall and the converging portion forming at least one fluidic path in which the product circulates, the converging portion comprising an inner wall of the nozzle, at least one of the inner wall and the peripheral wall of the core being provided with a plurality of steps, each step being defined by a transverse wall that extends in a plane secant to the axis and a longitudinal wall substantially parallel to the axis, the steps forming obstacles in the fluidic path, the nozzle comprising at least one supply channel of the swirling chamber opening tangentially into the swirling chamber, wherein the swirling chamber comprises a pre-chamber upstream from said converging portion, with the channel or channels opening into the pre-chamber;

wherein the core comprises a cone-shaped portion revolving about the axis and defining a top located next to the dispensing orifice.

* * * * *